US011952706B2

(12) United States Patent
Hettinger et al.

(10) Patent No.: US 11,952,706 B2
(45) Date of Patent: Apr. 9, 2024

(54) WASHING MACHINE APPLIANCE AND METHOD FOR FLOOD PROTECTION OPERATION

(71) Applicant: Haier US Appliance Solutions, Inc., Wilmington, DE (US)

(72) Inventors: Stephen Edward Hettinger, Louisville, KY (US); Ryan Ellis Leonard, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 55 days.

(21) Appl. No.: 17/517,988

(22) Filed: Nov. 3, 2021

(65) Prior Publication Data

US 2023/0134278 A1 May 4, 2023

(51) Int. Cl.

| | |
|---|---|
| ***D06F 39/08*** | (2006.01) |
| ***D06F 33/42*** | (2020.01) |
| ***D06F 33/47*** | (2020.01) |
| *D06F 103/18* | (2020.01) |
| *D06F 103/24* | (2020.01) |

(52) U.S. Cl.

CPC ..... *D06F 39/082* (2013.01); *D06F 33/42* (2020.02); *D06F 33/47* (2020.02); *D06F 39/085* (2013.01); *D06F 2103/18* (2020.02); *D06F 2103/24* (2020.02)

(58) Field of Classification Search

CPC ..... D06F 33/34; D06F 33/42; D06F 33/47; D06F 33/54; D06F 33/62; D06F 33/74; D06F 34/14; D06F 34/20; D06F 37/42; D06F 39/081; D06F 39/082; D06F 39/085; D06F 39/087; D06F 2103/00;

(Continued)

(56) References Cited

U.S. PATENT DOCUMENTS

| | | | | |
|---|---|---|---|---|
| 2003/0056300 | A1* | 3/2003 | Ruhl | D06F 33/42 68/12.02 |
| 2008/0178398 | A1 | 7/2008 | Darby | |
| 2021/0277561 | A1* | 9/2021 | Scheckelhoff | D06F 23/02 |

FOREIGN PATENT DOCUMENTS

| | | | |
|---|---|---|---|
| CA | 2181879 | C | 4/2002 |
| JP | H0430896 | A | 2/1992 |

(Continued)

OTHER PUBLICATIONS

Machine Translation of Choi et al., KR20100071670A, Jun. 2010. (Year: 2010).*

*Primary Examiner* — David G Cormier
(74) *Attorney, Agent, or Firm* — Dority & Manning, P.A.

(57) ABSTRACT

A washing machine appliance, a controller, and a method for operating a washing machine appliance are provided. The appliance includes a controller operably coupled to a motor assembly that is operably coupled to a wash basket, and a drain pump assembly. The controller is configured to rotate the wash basket to at least a desired speed; determine one or more of whether at least the desired speed of the wash basket is achieved within a period of time, or whether an energy parameter threshold of a motor assembly is exceeded when rotating the wash basket within the period of time; and generate an output signal corresponding to fluid detection at a wash tub when the wash basket fails to rotate to at least the desired speed within the period of time or, when the energy parameter threshold is exceeded when rotating the wash basket within the period of time.

18 Claims, 9 Drawing Sheets

(58) Field of Classification Search
CPC ..... D06F 2103/18; D06F 2103/24; D06F 2103/46; D06F 2105/58; D06F 2105/60
See application file for complete search history.

(56) References Cited

FOREIGN PATENT DOCUMENTS

| | | | | |
|---|---|---|---|---|
| KR | 20000004438 | A | | 1/2000 |
| KR | 20100071670 | A | * | 6/2010 |

* cited by examiner

WASHING MACHINE APPLIANCE AND METHOD FOR FLOOD PROTECTION OPERATION

FIELD

The present subject matter relates generally to washing machine appliances, or more specifically, to systems and methods for flood protection in a washing machine appliance.

BACKGROUND

Washing machine appliances generally include a cabinet which receives a wash tub for containing water or wash fluid (e.g., water and detergent, bleach, or other wash additives). The wash tub may be suspended within the cabinet by a suspension system to allow some movement relative to the cabinet during operation. A wash basket is rotatably mounted within the wash tub and defines a wash chamber for receipt of articles for washing. A drive assembly is coupled to the wash tub and is configured to selectively rotate the wash basket within the wash tub.

Washing machine appliances are typically equipped to operate in one or more modes or cycles, such as wash, rinse, and spin cycles. For example, during a wash or rinse cycle, the wash fluid is directed into the wash tub in order to wash and/or rinse articles within the wash chamber. In addition, the wash basket and/or an agitation element can rotate at various speeds to agitate or impart motion to articles within the wash chamber. During a spin cycle, the wash basket may be rotated at high speeds, e.g., to wring wash fluid from articles within the wash chamber.

Washing machine appliances generally include a sensor, such as a pressure sensor or pressure switch, configured to detect the water level in the wash tub. The sensor or switch adds cost to the product, can be prone to failure, or may be of limited availability due to materials or supply chain limitations (e.g., limitations related to electric or electronic components). Such sensors may generally determine whether a washing appliance may proceed to the next cycle or mode or whether further draining or water supply is necessary. Such sensors may also determine how much water may be added or removed from the wash tub.

If such sensors fail, the washing machine appliance may not be able to proceed with further cycle steps, or continued operation under deleterious conditions may occur. Sensor failure may allow the washing machine appliance to overfill or flood due to erroneous water level signals. Erroneous water level signals may include high readings due to insufficient drainage As such, a system and method for operating a washing machine appliance without such a sensor would be advantageous. Furthermore, a system and method for determining fault or failure at one or more sensors or component assemblies at a washing machine appliance would be advantageous.

BRIEF DESCRIPTION

Advantages of the invention will be set forth in part in the following description, or may be apparent from the description, or may be learned through practice of the invention.

An aspect of the present disclosure is directed to a washing machine appliance including a wash tub positioned within a cabinet and a wash basket rotatably mounted within the wash tub. A motor assembly is operably coupled to the wash basket for selectively rotating the wash basket. A drain pump assembly is fluidly coupled to the wash tub for selectively draining wash fluid from the wash tub. A controller is operably coupled to the motor assembly and the drain pump assembly. The controller is configured to rotate the wash basket to at least a desired speed; determine whether the wash basket is rotated to at least the desired speed within a period of time; generate an output signal corresponding to fluid detection at the wash tub when the wash basket fails to rotate to at least the desired speed within the period of time.

Another aspect of the present disclosure is directed to a washing machine appliance including a wash tub positioned within a cabinet, a wash basket rotatably mounted within the wash tub and defining a wash chamber, a motor assembly operably coupled to the wash basket for selectively rotating the wash basket, a drain pump assembly fluidly coupled to the wash tub for selectively draining wash fluid from the wash tub, and a controller operably coupled to the motor assembly and the drain pump assembly. The controller is configured to rotate the wash basket to at least a desired speed; determine whether an energy parameter threshold of the motor assembly is exceeded when rotating the wash basket within the period of time; and generate the output signal corresponding to fluid detection at the wash tub when the energy parameter threshold is exceeded when rotating the wash basket within the period of time.

Still another aspect of the present disclosure is directed to a controller for a washing machine appliance. The controller is configured to store instructions that, when executed by a processor, causes the washing machine appliance to perform operations. The operations include rotating a wash basket to at least a desired speed; determining one or more of whether at least the desired speed of the wash basket is achieved within a period of time, or whether an energy parameter threshold of a motor assembly is exceeded when rotating the wash basket within the period of time; and generating an output signal corresponding to fluid detection at a wash tub when the wash basket fails to rotate to at least the desired speed within the period of time or, when the energy parameter threshold is exceeded when rotating the wash basket within the period of time.

Yet another aspect of the present disclosure is directed to a method for operating a washing machine appliance. The method includes rotating a wash basket to at least a desired speed; determining one or more of whether at least the desired speed of the wash basket is achieved within a period of time, or whether an energy parameter threshold of a motor assembly is exceeded when rotating the wash basket within the period of time; and generating an output signal corresponding to fluid detection at a wash tub when the wash basket fails to rotate to at least the desired speed within the period of time or, when the energy parameter threshold is exceeded when rotating the wash basket within the period of time.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
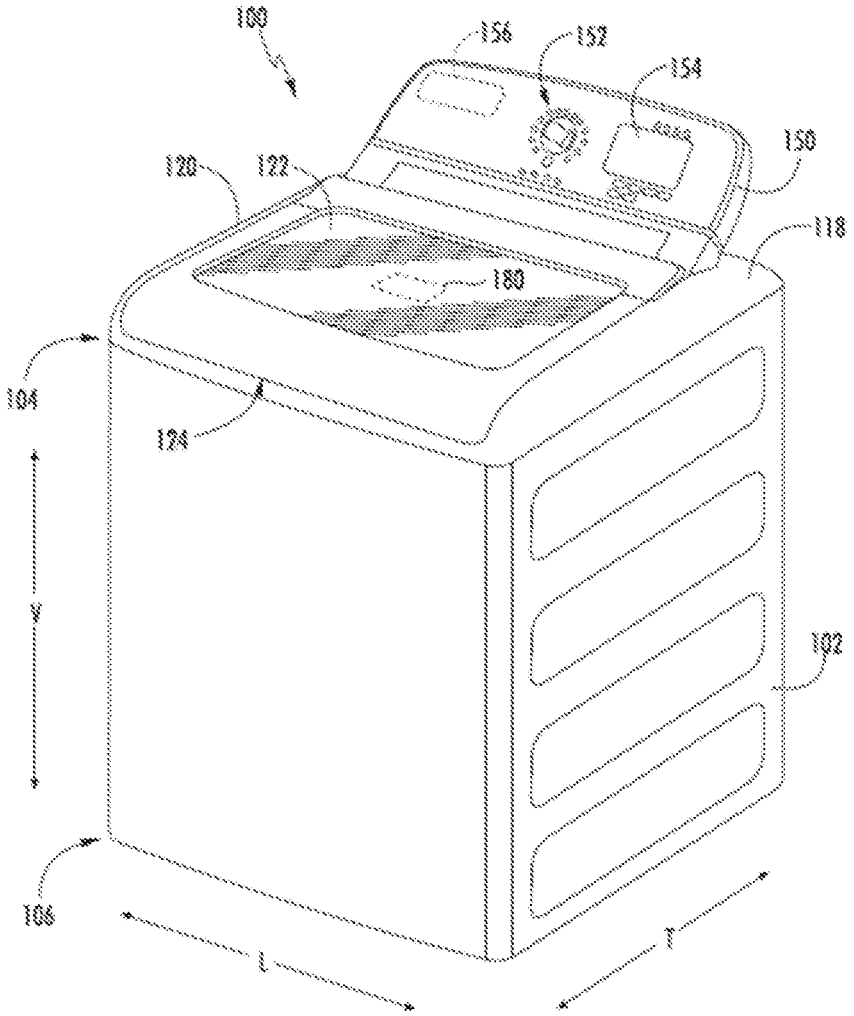
FIG. 1 provides a perspective view of a washing machine appliance according to an exemplary embodiment of the present subject matter with a door of the exemplary washing machine appliance shown in a closed position.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a 10 percent margin.

It should be appreciated that where a value is at a threshold, one skilled in the art may determine whether an action at the threshold may correspond to actions below the threshold or above the threshold. For instance, an action "below a threshold" may include values "at or below a threshold". In another instance, an action "above a threshold" may include values "at or above a threshold". One skilled in the art may alter the corresponding action of a value at or equal to a threshold without deviating from the scope of the present disclosure.

Embodiments of a washing machine appliance, a controller for a washing machine appliance, and a method for operating a washing machine appliance are provided. Embodiments provided herein allow for detection of presence of fluid (e.g., water or water-based solution) in a washer tub. Methods provided herein allow for determination of the presence of fluid within or outside of a wash cycle without requiring utilization of a fluid level sensor (e.g., a pressure sensor or switch, a load sensor or switch, a moisture sensor or switch, etc.). Embodiments provided herein may allow for detection of fluid presence in the wash tub while utilizing a fluid sensor, allowing for failure detection of a fluid level sensor or component, such as a drain pump assembly. Embodiments provided herein allow for sensor-less flood protection or fluid detection, fluid level sensor validation or failure determination, or determination of obstruction or non-operation of a wash drain or drain pump assembly.

Embodiments provided herein energize a motor assembly and rotate a wash basket to detect a characteristic signal indicative of fluid presence in a washer tub. The signal may include a measurement of time or rate of change in speed for the wash basket to perform one or more of accelerating from a first speed to a second speed, decelerating the wash basket from a first speed to a second speed, meeting or exceeding a rotational speed threshold of the wash basket after the motor assembly is energized for a predetermined period of time, and/or meeting or exceeding an energy parameter of the motor assembly within a predetermined period of time following energizing the motor assembly. Embodiments provided herein allow for determining fluid presence, fluid sensor fault, and/or drain pump fault based on whether one or more speed and/or energy parameter thresholds is met or exceeded within the period of time.

As used herein, "energy parameter" or "energy parameter threshold" refers to power, current, or voltage. Embodiments of the washing machine appliance and methods provided herein allow for utilizing a measurement, detection, or calculation of power, voltage, or current of the motor assembly for detection of presence of fluid at a wash tub, sensor-less flood protection or fluid detection, fluid level sensor validation or failure determination, or determination of obstruction or non-operation of a wash drain or drain pump assembly.

Embodiments of the washing machine appliance and methods provided herein allow for production and operation of washing machine appliances that do not require fluid level sensors, which may lower cost, improve reliability, or reduce false signals indicative of component or sensor failure (e.g., increased robustness in fault condition detection).

Figure 2:
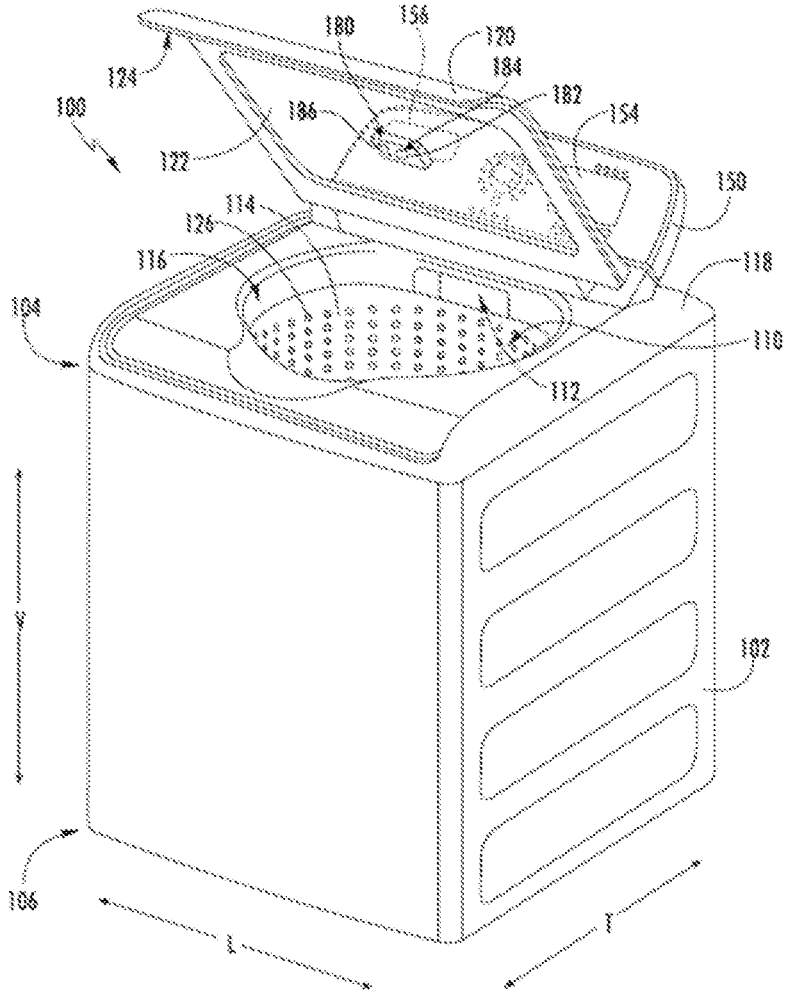
FIG. 2 provides a perspective view of the exemplary washing machine appliance of FIG. 1 with the door of the exemplary washing machine appliance shown in an open position.
Figure 3:
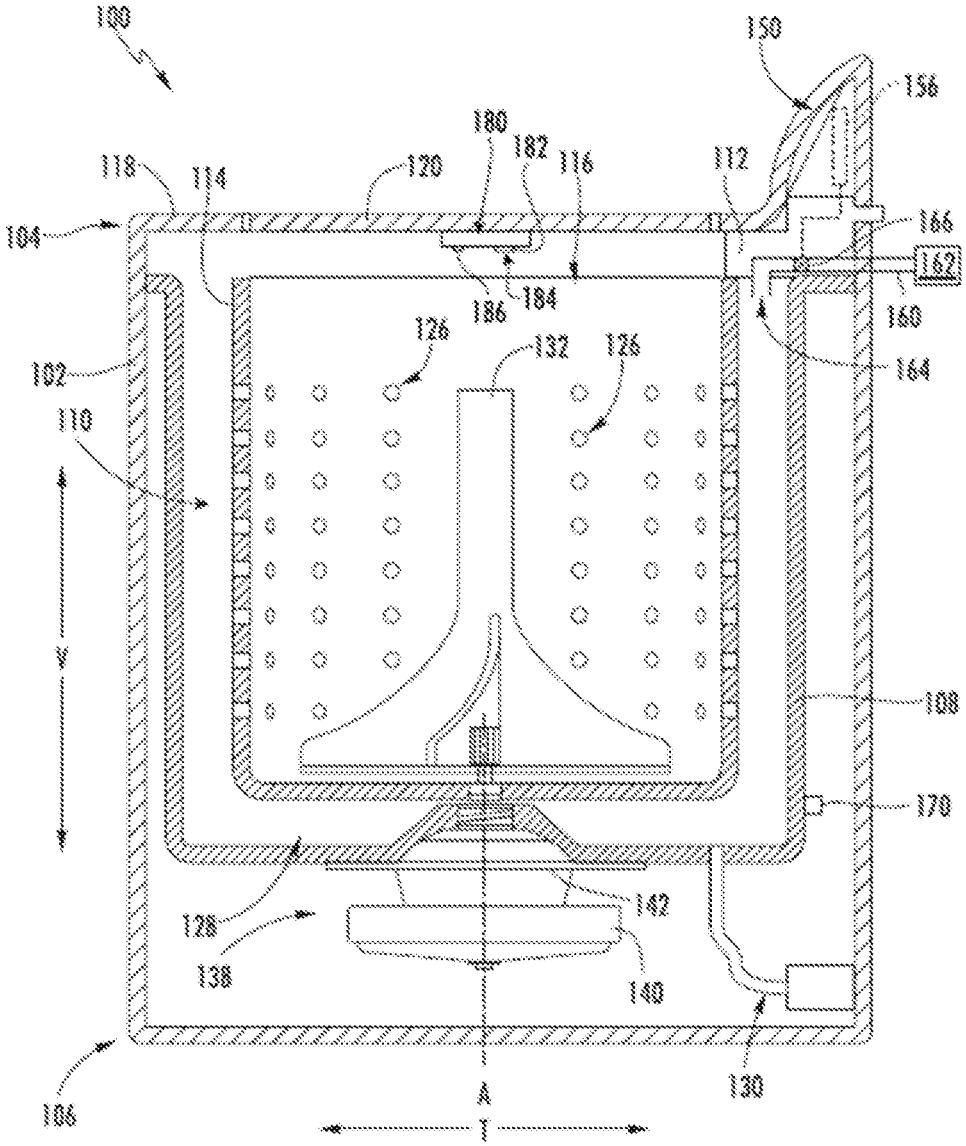
FIG. 3 provides a side cross-sectional view of the exemplary washing machine appliance of FIG. 1.

FIGS. 1 through 3 illustrate an exemplary embodiment of a vertical axis washing machine appliance 100. Specifically, FIGS. 1 and 2 illustrate perspective views of washing machine appliance 100 in a closed and an open position, respectively. FIG. 3 provides a side cross-sectional view of washing machine appliance 100. Washing machine appliance 100 generally defines a vertical direction V, a lateral direction L, and a transverse direction T, each of which is mutually perpendicular, such that an orthogonal coordinate system is generally defined.

While described in the context of a specific embodiment of vertical axis washing machine appliance 100, it should be appreciated that vertical axis washing machine appliance 100 is provided by way of example only. It will be understood that aspects of the present subject matter may be used in any other suitable washing machine appliance, such as a horizontal axis washing machine appliance. Indeed, modifications and variations may be made to washing machine appliance 100, including different configurations, different appearances, and/or different features while remaining within the scope of the present subject matter.

Washing machine appliance 100 has a cabinet 102 that extends between a top portion 104 and a bottom portion 106 along the vertical direction V, between a first side (left) and a second side (right) along the lateral direction L, and between a front and a rear along the transverse direction T. As best shown in FIG. 3, a wash tub 108 is positioned within cabinet 102, defines a wash chamber 110, and is generally configured for retaining wash fluids during an operating cycle. Washing machine appliance 100 further includes a primary dispenser 112 (FIG. 2) for dispensing wash fluid into wash tub 108. The term "wash fluid" refers to a liquid used for washing and/or rinsing articles during an operating cycle and may include any combination of water, detergent, fabric softener, bleach, and other wash additives or treatments.

In addition, washing machine appliance 100 includes a wash basket 114 that is positioned within wash tub 108 and generally defines an opening 116 for receipt of articles for washing. More specifically, wash basket 114 is rotatably mounted within wash tub 108 such that it is rotatable about an axis of rotation A. According to the illustrated embodiment, the axis of rotation A is substantially parallel to the vertical direction V. In this regard, washing machine appliance 100 is generally referred to as a "vertical axis" or "top load" washing machine appliance 100. However, it should be appreciated that aspects of the present subject matter may be used within the context of a horizontal axis or front load washing machine appliance as well.

As illustrated, cabinet 102 of washing machine appliance 100 has a top panel 118. Top panel 118 defines an opening (FIG. 2) that coincides with opening 116 of wash basket 114 to permit a user access to wash basket 114. Washing machine appliance 100 further includes a door 120 which is rotatably mounted to top panel 118 to permit selective access to opening 116. In particular, door 120 selectively rotates between the closed position (as shown in FIGS. 1 and 3) and the open position (as shown in FIG. 2). In the closed position, door 120 inhibits access to wash basket 114. Conversely, in the open position, a user can access wash basket 114. A window 122 in door 120 permits viewing of wash basket 114 when door 120 is in the closed position, e.g., during operation of washing machine appliance 100. Door 120 also includes a handle 124 that, e.g., a user may pull and/or lift when opening and closing door 120. Further, although door 120 is illustrated as mounted to top panel 118, door 120 may alternatively be mounted to cabinet 102 or any other suitable support.

As best shown in FIGS. 2 and 3, wash basket 114 further defines a plurality of perforations 126 to facilitate fluid communication between an interior of wash basket 114 and wash tub 108. In this regard, wash basket 114 is spaced apart from wash tub 108 to define a space for wash fluid to escape wash chamber 110. During a spin cycle, wash fluid within articles of clothing and within wash chamber 110 is urged through perforations 126 wherein it may collect in a sump 128 defined by wash tub 108. Washing machine appliance 100 further includes a pump assembly 130 (FIG. 3) that is located beneath wash tub 108 and wash basket 114 for gravity assisted flow when draining wash tub 108.

An impeller or agitation element 132 (FIG. 3), such as a vane agitator, impeller, auger, oscillatory basket mechanism, or some combination thereof is disposed in wash basket 114 to impart an oscillatory motion to articles and liquid in wash basket 114. More specifically, agitation element 132 extends into wash basket 114 and assists agitation of articles disposed within wash basket 114 during operation of washing machine appliance 100, e.g., to facilitate improved cleaning. In different embodiments, agitation element 132 includes a single action element (i.e., oscillatory only), a double action element (oscillatory movement at one end, single direction rotation at the other end) or a triple action element (oscillatory movement plus single direction rotation at one end, single direction rotation at the other end). As illustrated in FIG. 3, agitation element 132 and wash basket 114 are oriented to rotate about axis of rotation A (which is substantially parallel to vertical direction V).

As best illustrated in FIG. 3, washing machine appliance 100 includes a drive assembly or motor assembly 138 in mechanical communication with wash basket 114 to selectively rotate wash basket 114 (e.g., during an agitation or a rinse cycle of washing machine appliance 100). In addition, motor assembly 138 may also be in mechanical communication with agitation element 132. In this manner, motor assembly 138 may be configured for selectively rotating or oscillating wash basket 114 and/or agitation element 132 during various operating cycles of washing machine appliance 100.

More specifically, motor assembly 138 may generally include one or more of a drive motor 140 and a transmission assembly 142, e.g., such as a clutch assembly, for engaging and disengaging wash basket 114 and/or agitation element 132. According to the illustrated embodiment, drive motor 140 is a brushless DC electric motor, e.g., a pancake motor. However, according to alternative embodiments, drive motor 140 may be any other suitable type or configuration of motor. For example, drive motor 140 may be an AC motor, an induction motor, a permanent magnet synchronous motor, or any other suitable type of motor. In addition, motor assembly 138 may include any other suitable number, types, and configurations of support bearings or drive mechanisms.

Referring to FIGS. 1 through 3, washing machine appliance 100 may include one or more speed sensors 180 for detecting a rotational speed of the wash basket 114. The speed sensor 180 may be mounted to the cabinet 102, the door 120, or any other appropriate position at the washing machine appliance 100 for detecting rotational speed. The speed sensor 180 may be configured to determine one or more discrete or transient speeds of rotary components of the washing machine appliance. Certain embodiments may configure the speed sensor 180 as a speed switch configured to determine whether a rotational speed threshold has been met or exceeded, such as described with regard to one or methods herein. Speed sensor 180 may include various components for detecting a rotational speed, such as a housing 182 and a sensor element 184. The speed sensor may be configured as any appropriate type of sensor for detecting component rotational speed, such as, but not limited to, a magneto-resistive sensor, a Hall effect sensor, or an inductive sensor.

Referring still to FIGS. 1 through 3, a control panel 150 with at least one input selector 152 (FIG. 1) extends from top panel 118. Control panel 150 and input selector 152 collectively form a user interface input for operator selection of machine cycles and features. A display 154 of control panel 150 indicates selected features, operation mode, a countdown timer, and/or other items of interest to appliance users regarding operation.

Operation of washing machine appliance 100 is controlled by a controller or processing device 156 that is operatively coupled to control panel 150 for user manipulation to select washing machine cycles and features. In response to user manipulation of control panel 150, controller 156 operates the various components of washing machine appliance 100 to execute selected machine cycles and features. The control panel 150 and/or controller 156 is configured in operative communication with one or more sensors (e.g., sensor 180, sensor 170), such as to receive and communicate via output signals, fault signals, validation signals, power output or consumption signals, current signal, voltage signal, or other energy parameter signal, speed signals, or thresholds, such as further described herein. According to an exemplary embodiment, controller 156 may include a memory and microprocessor, such as a general or special purpose microprocessor operable to execute programming instructions or micro-control code associated with methods described herein. Alternatively, controller 156 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 150 and other components of washing machine appliance 100 may be in communication with controller 156 via one or more signal lines or shared communication busses.

During operation of washing machine appliance 100, laundry items are loaded into wash basket 114 through opening 116, and washing operation is initiated through operator manipulation of input selectors 152. Wash basket 114 is filled with water and detergent and/or other fluid additives via primary dispenser 112. One or more valves can be controlled by washing machine appliance 100 to provide for filling wash tub 108 and wash basket 114 to the appropriate level for the amount of articles being washed and/or rinsed. By way of example for a wash mode, once wash basket 114 is properly filled with fluid, the contents of wash basket 114 can be agitated (e.g., with agitation element 132 as discussed previously) for washing of laundry items in wash basket 114.

More specifically, referring again to FIG. 3, a water fill process will be described according to an exemplary embodiment. As illustrated, washing machine appliance 100 includes a water supply conduit 160 that provides fluid communication between a water supply source 162 (such as a municipal water supply) and a discharge nozzle 164 for directing a flow of water into wash chamber 110. In addition, washing machine appliance 100 includes a water fill valve or water control valve 166 which is operably coupled to water supply conduit 160 and communicatively coupled to controller 156. In this manner, controller 156 may regulate the operation of water control valve 166 to regulate the amount of water within wash tub 108.

Although water supply conduit 160, water supply source 162, discharge nozzle 164, and water control valve 166 are all described and illustrated herein in the singular form, it should be appreciated that these terms may be used herein generally to describe a supply plumbing for providing hot and/or cold water into wash chamber 110. In this regard, water supply conduit 160 may include separate conduits for receiving hot and cold water, respectively. Similarly, water supply source 162 may include both hot- and cold-water supplies regulated by dedicated valves. In addition, washing machine appliance 100 may include one or more fluid level sensors 170 for detecting the amount of water and or clothes within wash tub 108. For example, fluid level sensor 170 may be operably coupled to a side of tub 108 for detecting the weight, load, or pressure of wash tub 108, which controller 156 may use to determine a volume of water in wash chamber 110 and a sub-washer load weight. The fluid level sensor 170 may form a sensor configured to determine one or more discrete values of pressure, load, weight, or moisture. Certain embodiments of the fluid level sensor 170 may form a switch configured to determine whether a threshold value has been met or exceeded.

After wash tub 108 is filled and the agitation phase of the wash cycle is completed, wash basket 114 can be drained, e.g., by drain pump assembly 130. Laundry articles can then be rinsed by again adding fluid to wash basket 114 depending on the specifics of the cleaning cycle selected by a user. The impeller or agitation element 132 may again provide agitation within wash basket 114. One or more spin cycles may also be used as part of the cleaning process. In particular, a spin cycle may be applied after the wash cycle and/or after the rinse cycle in order to wring wash fluid from the articles being washed. During a spin cycle, wash basket 114 is rotated at relatively high speeds to help wring fluid from the laundry articles through perforations 126. During or prior to the spin cycle, drain pump assembly 130 may operate to discharge wash fluid from wash tub 108, e.g., to an external drain. After articles disposed in wash basket 114 are cleaned and/or washed, the user can remove the articles from wash basket 114, e.g., by reaching into wash basket 114 through opening 116.

While described in the context of a specific embodiment of vertical axis washing machine appliance 100, using the teachings disclosed herein it will be understood that vertical axis washing machine appliance 100 is provided by way of example only. Other washing machine appliances having different configurations, different appearances, and/or different features may also be utilized with the present subject matter as well, e.g., horizontal axis washing machine appliances. In addition, aspects of the present subject matter may be utilized in a combination washer/dryer appliance.

Now that the construction of washing machine appliance 100 and the configuration of controller 156 according to exemplary embodiments have been presented, an exemplary method 1000 of operating a washing machine appliance will be described (hereinafter, "method 1000"). Although the discussion below refers to the exemplary method 1000 of operating washing machine appliance 100, one skilled in the art will appreciate that the exemplary method 1000 is applicable to the operation of a variety of other washing machine appliances, such as horizontal axis washing machine appliances. In exemplary embodiments, the various method steps as disclosed herein may be performed by controller 156 or a separate, dedicated controller. Steps of the method 1000 may be stored as instructions in one or more memory devices associated with the controller 156. Steps of the method 1000 may be executed by embodiments of the motor assembly 138 and drain pump assembly 130 such as provided herein. Accordingly, the controller 156 or other control device may be configured to perform operations such as provided in one or more steps of the method 1000.

Figure 4:
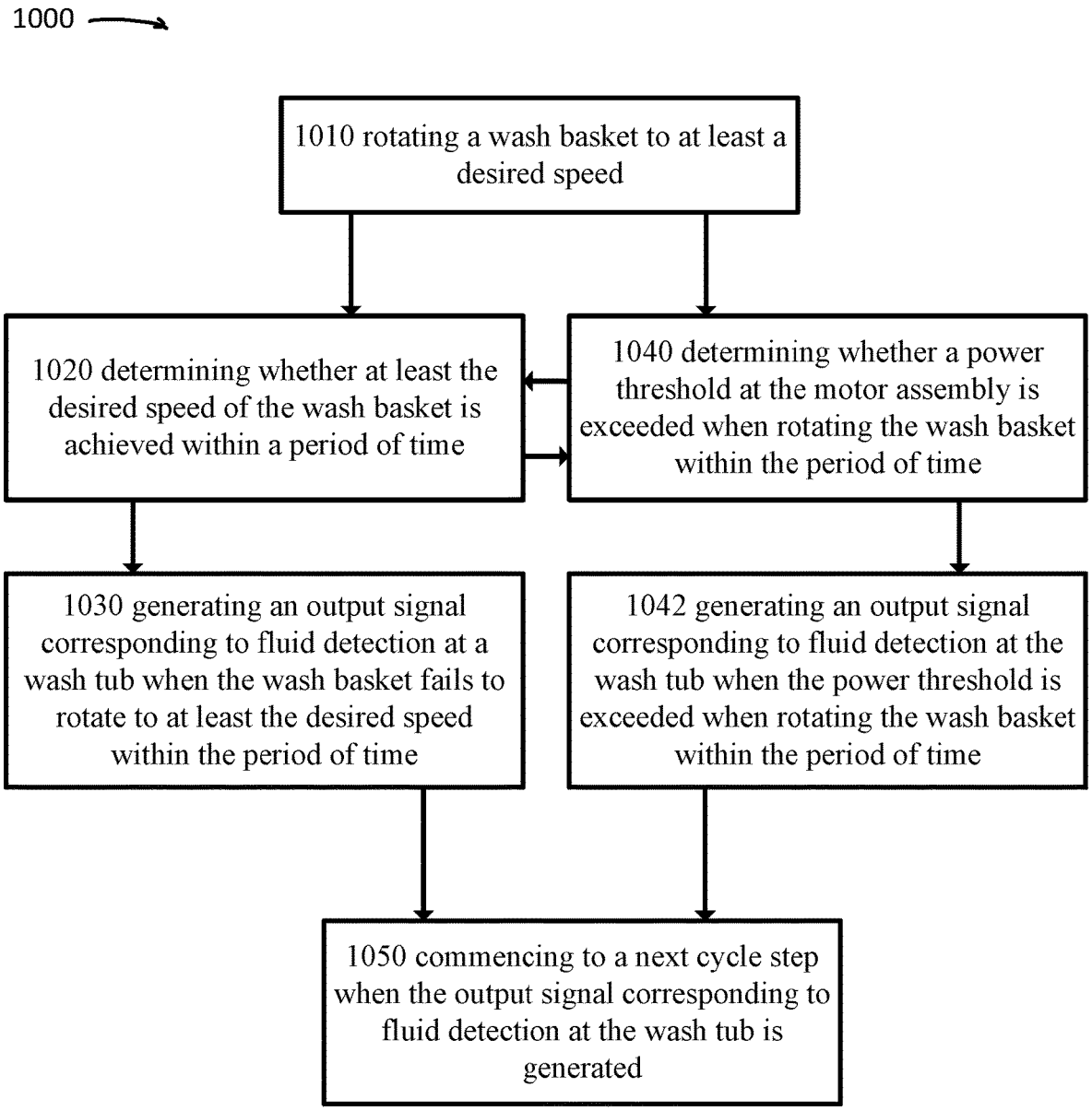
FIG. 4 illustrates a method for operating a washing machine appliance in accordance with one embodiment of the present disclosure.

Referring now to FIG. 4, a flowchart outlining exemplary steps of the method 1000 of operating a washing machine appliance is provided. The method 1000 includes at 1010 rotating a wash basket (e.g., wash basket 114) to at least a desired speed. The desired speed may correspond to one or more speeds for performing a spin cycle at a washing machine appliance. It should be appreciated that the spin cycle may include any cycle at which the wash basket is rotated to or toward a desired speed without the addition of fluid during rotation, or following draining of fluid prior to rotation, or any other appropriate cycle step at which fluid at the wash basket and/or wash tub is expected or have been removed prior to commencing the spin cycle. The method 1000 may further include rotating the wash basket to at least a desired speed for a period of time. Rotating the wash basket may include energizing the motor assembly (e.g., motor assembly 138), such as providing an energy parameter (e.g., power or current) to the motor assembly, to rotate the wash basket.

The method 1000 includes at 1020 determining whether at least the desired speed of the wash basket is achieved within a period of time. The method 1000 includes at 1030 generating an output signal corresponding to fluid detection at a wash tub (e.g., wash tub 108) when the wash basket fails to rotate to at least the desired speed within the period of time.

Figure 5:
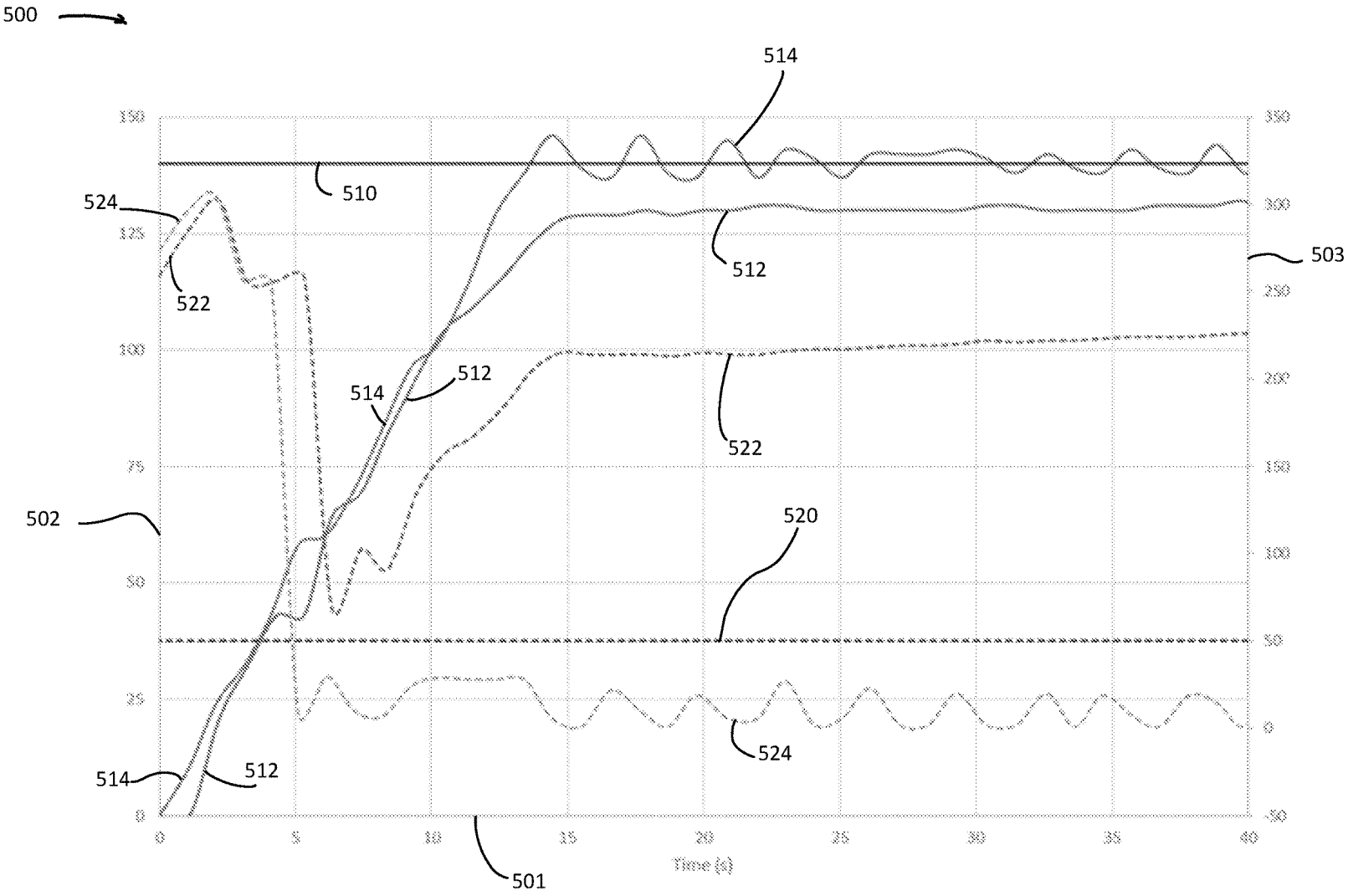
FIG. 5 illustrates an exemplary graph depicting speed and an energy parameter at a washing machine appliance versus a period of time in accordance exemplary embodiments of the method for operating a washing machine appliance.

Referring briefly to FIG. 5, an exemplary graph 500 depicting an energy parameter (at axis 502) versus time (at axis 501) is provided in accordance with embodiments of the method 1000. Graph 500 further depicts wash basket speed (at axis 503) versus time 501. Line 510 depicts a target threshold speed, such as the desired speed in accordance with the method 1000 at step 1010. The target threshold speed may correspond to a desired rotational speed of a wash basket for performing a spin cycle. Line 514 depicts an exemplary speed of the wash basket over the period of time when no fluid is present in the wash basket or wash tub. Line 512 depicts an exemplary speed of the wash basket over the period of time when fluid is present at the wash basket or wash tub. When fluid is present in the wash tub, such as depicted at line 512, the rotational speed of the wash basket fails to meet or exceed the target speed threshold 510 within the period of time. When fluid is not present in the wash tub, such as depicted at line 514, the rotational speed of the wash basket meets or exceeds the target speed threshold 510 within the period of time.

Referring still to FIG. 5, line 520 depicts a target power or current usage threshold, such as the desired power or current utilized by the motor assembly. The target power or current may correspond to the target threshold speed. For instance, the power or current may correspond to a predetermined value for meeting or exceeding the target threshold speed when fluid is not present in the wash tub. In another embodiment, the power or current may correspond to a predetermined value based on a desired energy usage of the washing machine appliance. Line 524 depicts an exemplary power or current usage of the motor assembly when no fluid is present at the wash basket or wash tub. Line 522 depicts an exemplary power or current usage at the motor assembly over the period of time when fluid is present at the wash basket or wash tub. When fluid is present in the wash tub, such as depicted at line 522, the power or current usage at the motor assembly exceeds the target power or current usage threshold 520 within the period of time. When fluid is not present in the wash tub, such as depicted at line 524, the power or current usage of the motor assembly does not exceed the target power or current usage threshold 520 within the period of time.

It should be appreciated that the term "fluid not present" or "fluid not detected" is relative to a minimum fluid level threshold desired or allowed for operation of the washing machine appliance. Accordingly, "fluid not present" or "fluid not detected" may correspond to a minimum pressure or load at the wash basket and/or wash tub, a minimum fluid level or height, or a minimum moisture content, or combinations thereof, as should be appreciated by one skilled in the art for washing machine appliances.

Referring back to FIG. 4, in certain embodiments, the method 1000 at 1020 includes obtaining, such as via a speed sensor, a speed signal corresponding to a measured, calculated, or otherwise obtained speed of rotation of the wash basket.

In various embodiments, the method 1000 includes at 1040 determining whether an energy parameter threshold of the motor assembly is exceeded when rotating the wash basket within the period of time, such as depicted with regard to FIG. 5. The method 1000 may further include at 1042 generating the output signal corresponding to fluid detection at the wash tub when the energy parameter threshold is exceeded when rotating the wash basket within the period of time.

In certain embodiments, the method 1000 includes at 1050 commencing to a next cycle step or an abatement cycle step when the output signal corresponding to fluid detection at the wash tub is generated. The output signal may command an end to the spin cycle. The output signal may additionally, or alternatively, command commencement of the next desired cycle or an abatement cycle. In a particular embodiment, the abatement cycle step may include a pump clearing cycle step. For instance, the abatement cycle step or pump clearing cycle step may include one or more commands or operations at the drain pump assembly, such as to scavenge and remove fluid from the wash tub and/or wash basket.

Figure 6:
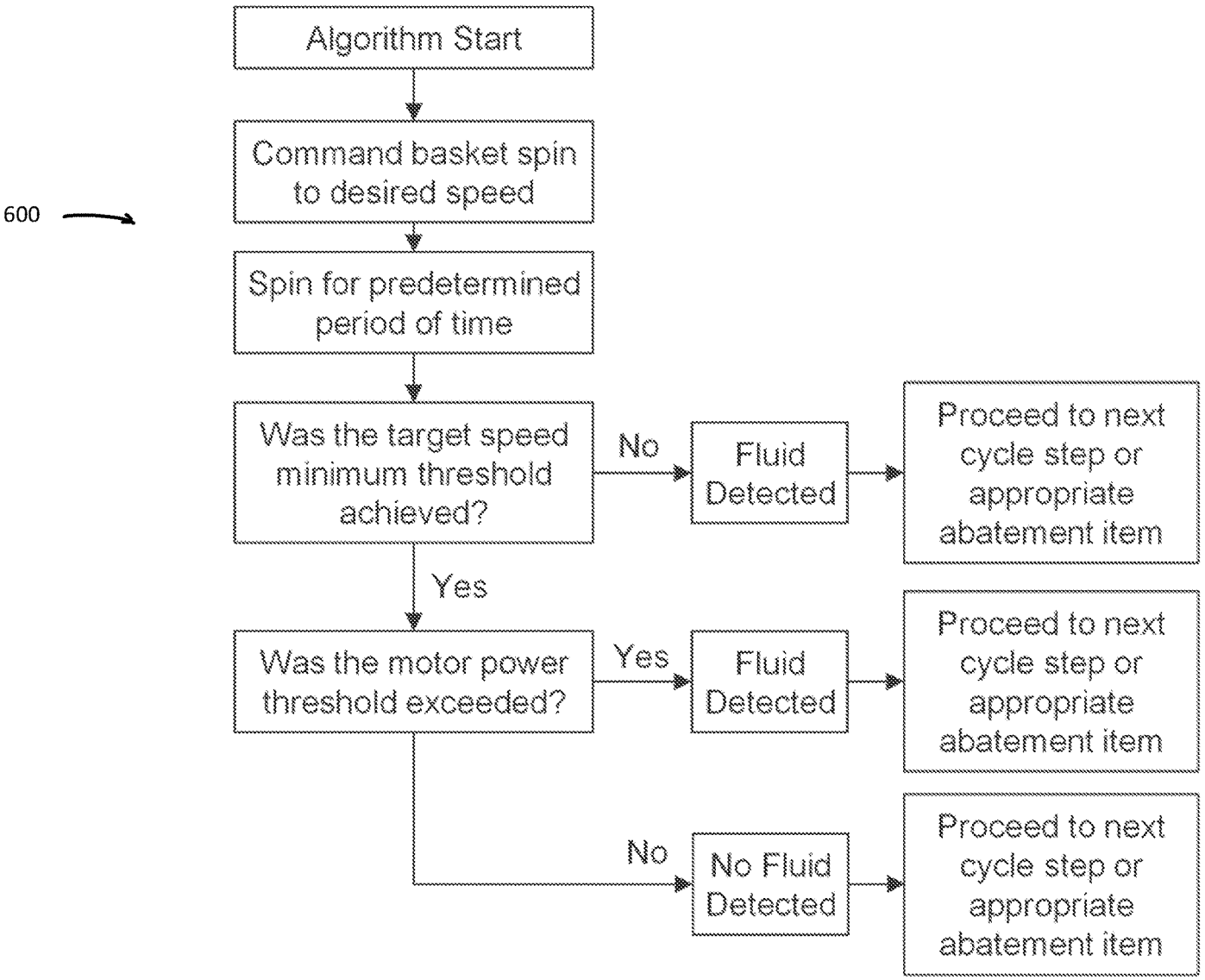
FIG. 6 provides a flow diagram of an exemplary process for implementing a fluid level detection method in a washing machine appliance according to an exemplary embodiment of the present subject matter.

Referring now to FIG. 6, a flow diagram 600 of an exemplary process for fluid detection at a washing machine appliance is provided. Embodiments of the flow diagram 600 may include or form one or more steps of the method 1000 for operating a washing machine appliance such as provided with regard to FIG. 4. The flow diagram 600 includes commanding basket spin to the desired speed and spinning for a predetermined period of time, such as provided at step 1010 of the method 1000. The flow diagram 600 determines whether the target speed threshold (e.g., threshold 510 in FIG. 5) was achieved (e.g., met or exceeded), such as provided at step 1020 of the method 1000. If the wash basket fails to achieve the target speed threshold (e.g., line 512 in FIG. 5) then fluid is detected and the output signal may be generated accordingly, such as provided at step 1030. If the wash basket meets or exceeds the target speed threshold, the method and process may then include determining whether power (or current) at the motor assembly was exceeded, such as provided at step 1040 of the method 1000. If power at the motor assembly was exceeded (e.g., line 522 in FIG. 5) then fluid is detected and the output signal may be generated, such as provided at step 1042 of the method 1000. If power at the motor assembly was not exceeded (e.g., line 524 in FIG. 5) then no fluid is detected at the wash tub. The method 1000 may include proceeding to a next cycle step or appropriate abatement cycle step, such as provided at step 1050 of the method 1000.

Figure 7:
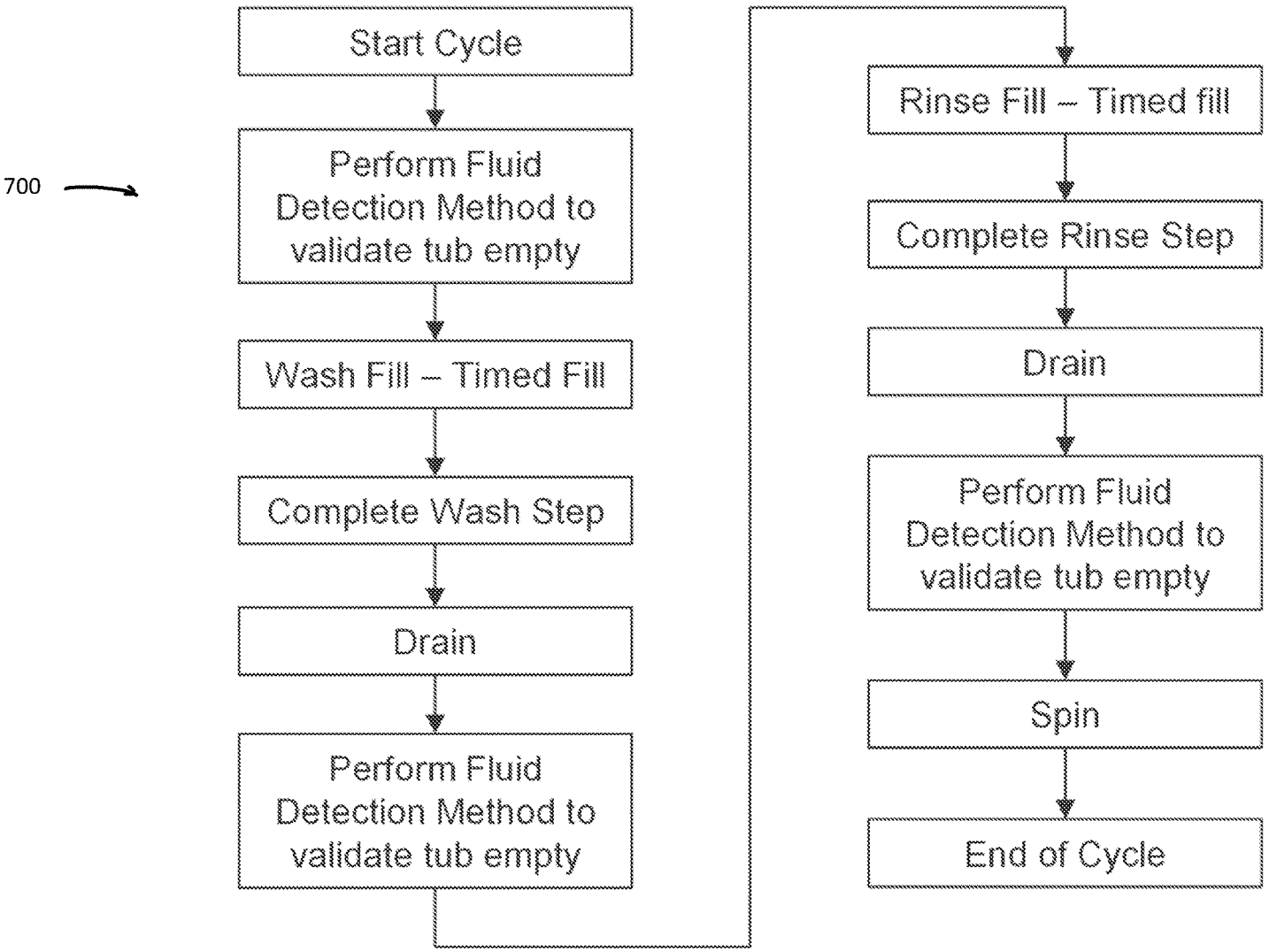
FIG. 7 provides a flow diagram of an exemplary process for fluid detection without a fluid level sensor at a washing machine appliance.

Referring now to FIG. 7, a flow diagram 700 of an exemplary process for fluid detection without a fluid level sensor at a washing machine appliance is provided. The flow diagram 700 depicts steps that may form one or more "next cycle steps" as provided above with regard to step 1050 of the method 1000. It should be appreciated that rotating the wash basket at step 1010 may include spinning the wash basket for a predetermined period of time prior to performing a wash cycle step, a rinse cycle step, or a spin cycle step. Embodiments of methods for operating a washing machine appliance may include starting or commencing the wash cycle, performing one or more steps of the method 1000 such as provided herein, filling the wash basket with washing fluid, performing and completing a wash step, draining the washing fluid, performing one or more steps of the method 1000, filling the wash basket with a rinsing fluid, performing and completing a rinse step, draining the rinse fluid, performing one or more steps of the method 1000, performing a spin cycle (e.g., to remove excess fluid from clothes or other wash articles), and ending the wash cycle. Although the flow diagram 700 depicts the serial arrangement of the steps provided above, it should be appreciated that certain steps may be started, restarted, rearranged, paused, or ended in any desired order by a controller or user input.

Figure 8:
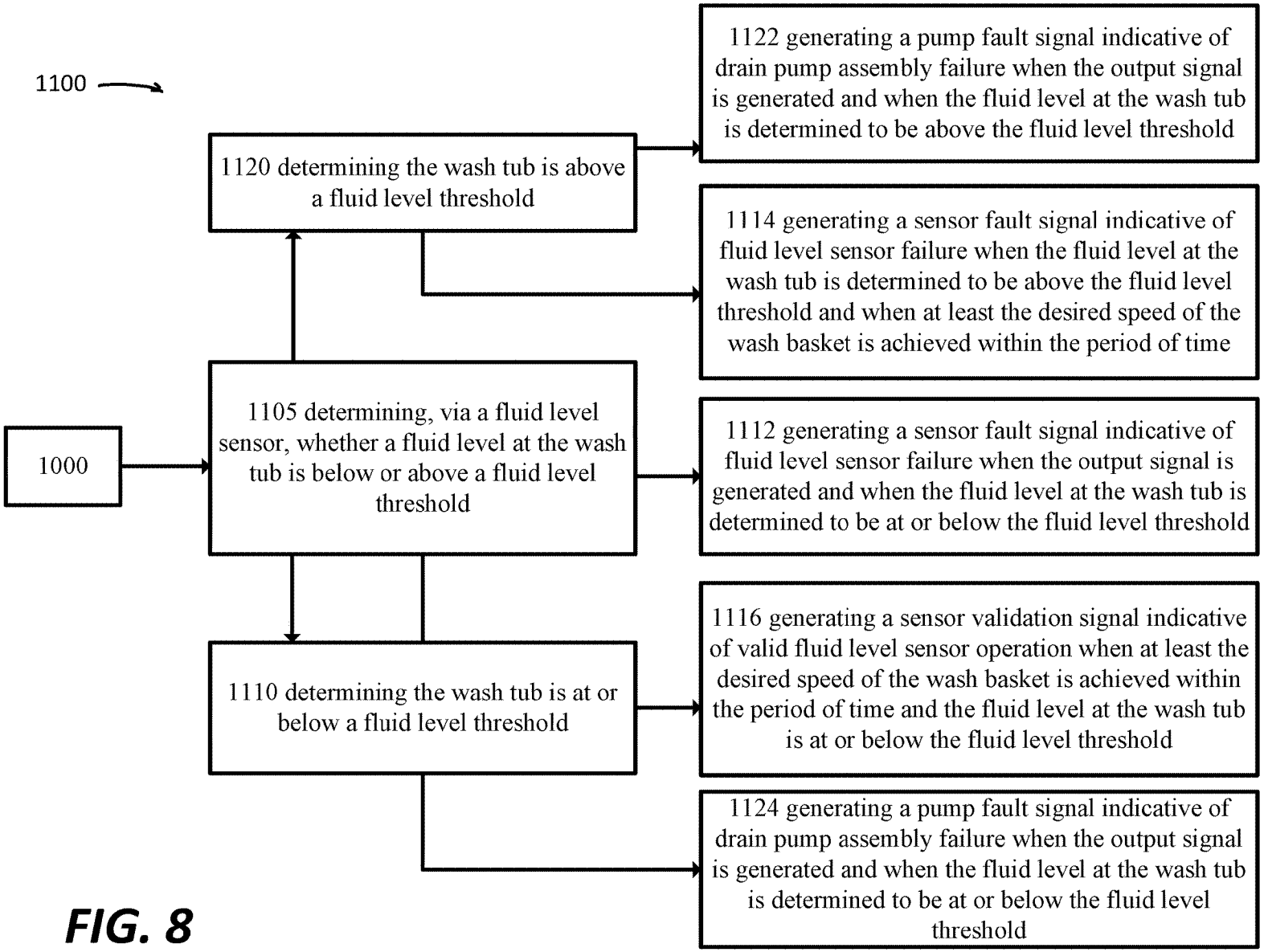
FIG. 8 illustrates a method for operating a washing machine appliance in accordance with one embodiment of the present disclosure.

Referring now to FIG. 8, a flowchart outlining exemplary steps of a method for operating a washing machine appliance is provided (hereinafter, "method 1100"). Method 1100 may particularly provide a method for determining fault or failure at one or more sensors and/or drain pump assemblies at a washing machine appliance. Embodiments of the method 1100 provided herein may include one or more steps of the method 1000 provided herein.

Certain embodiments of the method 1100 include at 1105 determining, via a fluid level sensor, whether a fluid level at the wash tub is below or above a fluid level threshold. In a particular embodiment, the method 1100 includes at 1110 determining, via a fluid level sensor, whether a fluid level at the wash tub is at or below a fluid level threshold, and at 1120 determining, via a fluid level sensor, whether a fluid level at the wash tub is above a fluid level threshold. As provided above, the fluid level threshold may include a measurement or calculation of minimum fluid level or height, a minimum pressure or load, or a minimum moisture content. The method 1100 may include at 1112 generating a sensor fault signal indicative of fluid level sensor failure when the output signal is generated (e.g., step 1030) and when the fluid level at the wash tub is determined to be at or below the fluid level threshold. The method 1100 may include at 1114 generating a sensor fault signal indicative of fluid level sensor failure when the fluid level at the wash tub is determined to be above the fluid level threshold and when at least the desired speed of the wash basket is achieved within the period of time. The method 1100 may include at 1116 generating a sensor validation signal indicative of valid fluid level sensor operation when at least the desired speed of the wash basket is achieved within the period of time and the fluid level at the wash tub is at or below the fluid level threshold.

In various embodiments, the method 1100 may include at 1124 generating a pump fault signal indicative of drain pump assembly failure when the output signal (e.g., step 1030) is generated and when the fluid level at the wash tub is determined to be at or below the fluid level threshold. In a particular embodiment, the method 1100 determines at 1110 the wash tub is at or below a fluid level threshold and then at 1124 generates the pump fault signal.

Still certain embodiments of the method 1100 may include at 1122 generating a pump fault signal indicative of drain pump assembly failure when the output signal (e.g., step 1030) is generated and when the fluid level at the wash tub is determined to be above the fluid level threshold. In a particular embodiment, the method 1100 determines at 1120 the wash tub is above a fluid level threshold and then at 1122 generates the pump fault signal. In a still particular embodiment, the method 1100 additionally generates the sensor fault signal at 1114 and the pump fault signal at 1122.

Figure 9:
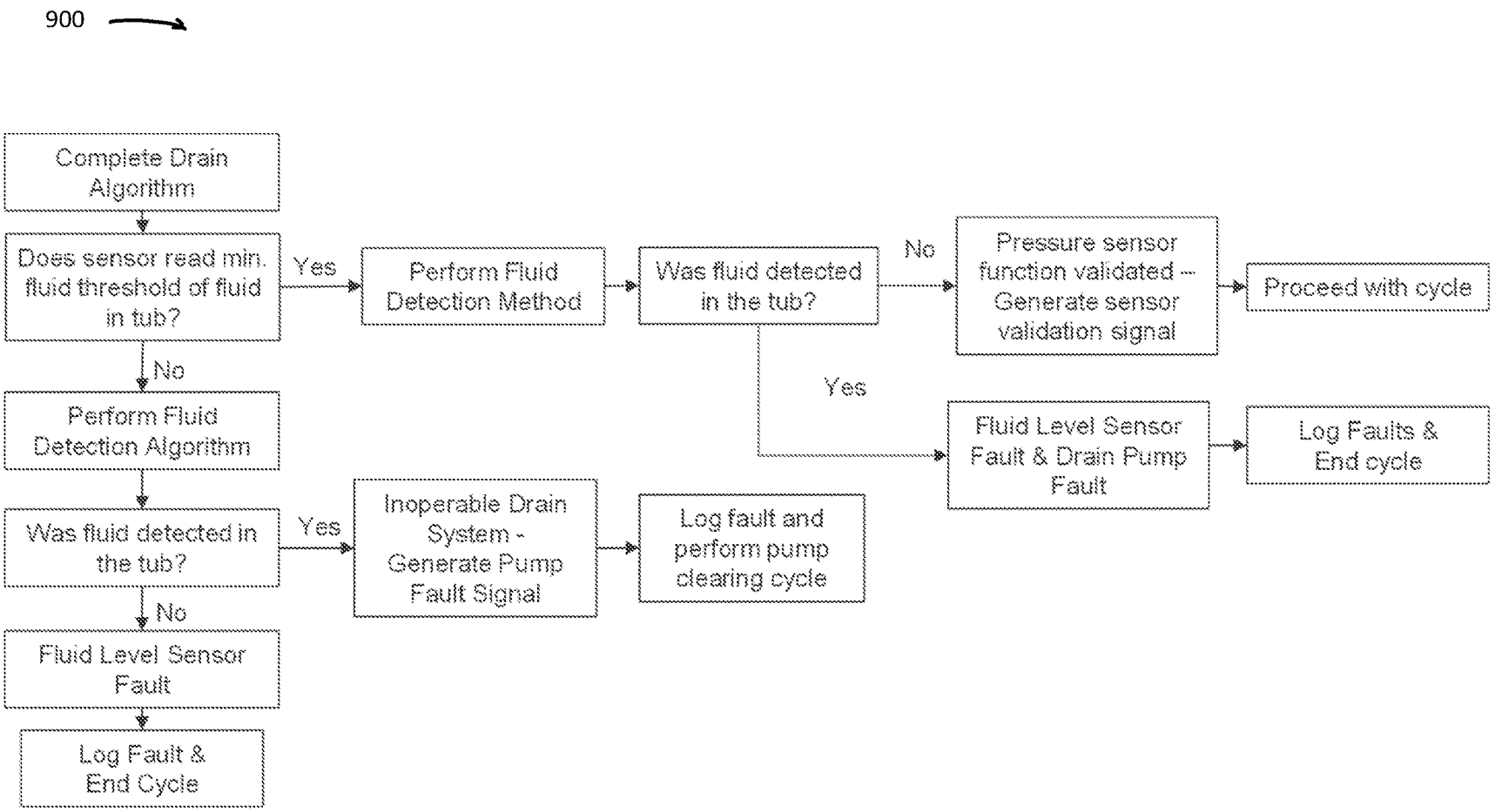
FIG. 9 provides a flow diagram of an exemplary process for determining sensor failure, sensor validation, and component failure at a washing machine appliance.

Referring now to FIG. 9, a flow diagram 900 of an exemplary process for operating a washing machine appliance such as provided in regard to the method flowchart of FIG. 8. The flow diagram 900 may particularly apply for determining sensor failure and/or pump failure at a washing machine appliance. Accordingly, the embodiment depicted in FIG. 9 may particularly include a fluid level sensor (e.g., a pressure sensor, moisture sensor, a load sensor, or other appropriate device for determining the presence of fluid in a wash tub). The methods, processes, and flowcharts depicted in FIGS. 8-9 may particularly allow for failure determination of a sensor and/or pump and/or sensor and/or pump operation validation.

Embodiments of the method 1100 may commence after completing a drain algorithm such as may be performed following any one or more process steps in FIG. 7 denoted as "Drain". A fluid level sensor determines whether there is a minimum fluid threshold of fluid in the wash tub, such as provided at 1105, 1110, or 1120 of the method 1100. The method may compare the determination of the fluid level sensor to the output of the fluid detection method 1000 when performed.

When the method 1000 determines that there is no fluid in the wash tub (e.g., via method 1000 at 1030) while the fluid level sensor determines that there is a minimum fluid threshold or less of fluid in the wash tub (e.g., at 1105 or 1110) then this indicates that the fluid level sensor is functioning properly and the sensor validation signal is generated (e.g., via method 1100 at 1116). When the method 1000 determines that there is fluid in the wash tub (e.g., via method 1000 at 1030) while the fluid level sensor determines that there is a minimum fluid threshold or less of fluid in the wash tub (e.g., at 1105 or 1110) then this indicates that the fluid level sensor is not functioning properly and a sensor fault signal is generated (e.g., via method 1100 at 1114).

When the method 1000 determines that there is fluid in the wash tub (e.g., via method 1000 at 1030) while the fluid level sensor determines that there is greater than a minimum fluid threshold (i.e., above the threshold) in the wash tub (e.g., at 1105 or 1120) then this indicates that the drain pump assembly (e.g., drain pump assembly 130) is not working properly, such as failing to sufficiently or completely drain the fluid from the wash tub. Accordingly, a pump fault signal (e.g., at 1122) is generated when the output signal is generated (e.g., at 1030) and when the fluid level at the wash tub is determined to be above the fluid level threshold.

When the method 1000 determines that there is not fluid in the wash tub (e.g., via method 1000 at 1030) while the fluid level sensor determines that there is greater than a minimum fluid threshold (i.e., above the threshold) in the wash tub (e.g., at 1105 or 1120) then this indicates that the fluid level sensor is not working properly. Accordingly, a sensor fault signal (e.g., at 1114) is generated when the fluid level at the wash tub is determined to be above the fluid level threshold and when at least the desired speed of the wash basket is achieved within the period of time.

Further aspects of the subject matter are provided by one or more of the following clauses:

A controller for a washing machine appliance, the controller storing instructions that, when executed by a processor, causes the washing machine appliance to perform operations, the operations including rotating a wash basket to at least a desired speed; determining one or more of whether at least the desired speed of the wash basket is achieved within a period of time, or whether an energy parameter threshold of a motor assembly is exceeded when rotating the wash basket within the period of time; and generating an output signal corresponding to fluid detection at a wash tub when the wash basket fails to rotate to at least the desired speed within the period of time or, when the energy parameter threshold is exceeded when rotating the wash basket within the period of time.

The controller of any one or more clauses herein, wherein determining whether at least the desired speed of the wash basket was achieved within the period of time includes obtaining, via a speed sensor, a speed signal corresponding to a measured speed of rotation of the wash basket.

The controller of any one or more clauses herein, the operations including commencing an abatement cycle when the output signal corresponding to fluid detection at the wash tub is generated.

The controller of any one or more clauses herein, the operations including determining, via a fluid level sensor, whether a fluid level at the wash tub is at or below a fluid level threshold; and generating a sensor fault signal indicative of fluid level sensor failure when the output signal is generated and when the fluid level at the wash tub is determined to be at or below the fluid level threshold.

The controller of any one or more clauses herein, the operations including determining, via a fluid level sensor, whether a fluid level at the wash tub is above a fluid level threshold; and generating a pump fault signal indicative of drain pump assembly failure when the output signal is generated and when the fluid level at the wash tub is determined to be above the fluid level threshold.

The controller of any one or more clauses herein, the operations including commencing a pump clearing cycle when the pump fault signal is generated.

The controller of any one or more clauses herein, the operations including determining, via a fluid level sensor, whether a fluid level at the wash tub is at or below a fluid level threshold; and generating a sensor fault signal indicative of fluid level sensor failure when the fluid level at the wash tub is determined to be above the fluid level threshold and when at least the desired speed of the wash basket is achieved within the period of time.

The controller of any one or more clauses herein, the operations including determining, via a fluid level sensor, whether a fluid level at the wash tub is at or below a fluid level threshold; and generating a sensor validation signal indicative of valid fluid level sensor operation when at least the desired speed of the wash basket is achieved within the period of time and the fluid level at the wash tub is at or below the fluid level threshold.

A washing machine appliance including the controller of any one or more clauses herein.

A washing machine appliance including a wash tub positioned within a cabinet; a wash basket rotatably mounted within the wash tub and defining a wash chamber; a motor assembly operably coupled to the wash basket for selectively rotating the wash basket; a drain pump assembly fluidly coupled to the wash tub for selectively draining wash fluid from the wash tub; and the controller of any one or more clauses herein operably coupled to the motor assembly and the drain pump assembly.

A method for operating a washing machine appliance, the method including rotating a wash basket to at least a desired speed; determining one or more of whether at least the desired speed of the wash basket is achieved within a period of time, or whether an energy parameter threshold of a motor assembly is exceeded when rotating the wash basket within the period of time; and generating an output signal corresponding to fluid detection at a wash tub when the wash basket fails to rotate to at least the desired speed within the period of time or, when the energy parameter threshold is exceeded when rotating the wash basket within the period of time.

A method for determining fault or failure at one or more sensors and/or drain pump assemblies at a washing machine appliance, the method including rotating a wash basket to at least a desired speed; determining one or more of whether at least the desired speed of the wash basket is achieved within a period of time, or whether an energy parameter threshold of a motor assembly is exceeded when rotating the wash basket within the period of time; and generating an output signal corresponding to fluid detection at a wash tub when the wash basket fails to rotate to at least the desired speed within the period of time or, when the energy parameter threshold is exceeded when rotating the wash basket within the period of time.

The method of any one or more clauses herein, the method including determining whether a fluid level at the wash tub is at or below a fluid level threshold; and generating a sensor fault signal indicative of fluid level sensor failure when the output signal is generated and when the fluid level at the wash tub is determined to be at or below the fluid level threshold.

The method of any one or more clauses herein, the method including determining whether a fluid level at the wash tub is above a fluid level threshold; and generating a pump fault signal indicative of drain pump assembly failure when the output signal is generated and when the fluid level at the wash tub is determined to be above the fluid level threshold.

The method of any one or more clauses herein, the method including commencing a pump clearing cycle when the pump fault signal is generated.

The method of any one or more clauses herein, the method including determining whether a fluid level at the wash tub is at or below a fluid level threshold; and generating a sensor fault signal indicative of fluid level sensor failure when the fluid level at the wash tub is determined to be above the fluid level threshold and when at least the desired speed of the wash basket is achieved within the period of time.

The method of any one or more clauses herein, the method including determining whether a fluid level at the wash tub is at or below a fluid level threshold; and generating a sensor validation signal indicative of valid fluid level sensor operation when at least the desired speed of the wash basket is achieved within the period of time and the fluid level at the wash tub is at or below the fluid level threshold.

A washing machine appliance configured to execute the method of any one or more clauses herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance, comprising:
a wash tub positioned within a cabinet;
a wash basket rotatably mounted within the wash tub and defining a wash chamber;
a motor assembly operably coupled to the wash basket for selectively rotating the wash basket;
a drain pump assembly fluidly coupled to the wash tub for selectively draining wash fluid from the wash tub;
a fluid level sensor configured to generate a fluid level signal corresponding to a fluid level at the wash tub; and
a controller operably coupled to the motor assembly and the drain pump assembly, the controller being configured to:
rotate the wash basket to at least a desired speed;
determine whether the wash basket is rotated to at least the desired speed within a period of time;
generate an output signal corresponding to fluid detection at the wash tub when the wash basket fails to rotate to at least the desired speed within the period of time; and
generate a sensor fault signal indicative of fluid level sensor failure when the fluid level at the wash tub is determined by the fluid level sensor to be above a fluid level threshold and when at least the desired speed of the wash basket is achieved within the period of time.

2. The washing machine appliance of claim 1, the controller being configured to:
determine whether an energy parameter threshold of the motor assembly is exceeded when rotating the wash basket within the period of time; and
generate the output signal corresponding to fluid detection at the wash tub when the energy parameter threshold is exceeded when rotating the wash basket within the period of time.

3. The washing machine appliance of claim 1, the washing machine appliance comprising:
a speed sensor configured to generate a speed signal corresponding to a speed of rotation of the wash basket,
wherein determining whether at least the desired speed of the wash basket was achieved within the period of time comprises obtaining the speed signal via the speed sensor.

4. The washing machine appliance of claim 1, the controller being configured to:
commence an abatement cycle when the output signal corresponding to fluid detection at the wash tub is generated.

5. The washing machine appliance of claim 4, wherein the abatement cycle comprises operating the drain pump assembly to drain fluid from the wash tub.

6. The washing machine appliance of claim 1,
wherein the controller is configured to generate a sensor fault signal indicative of fluid level sensor failure when the output signal is generated and when the fluid level at the wash tub is determined to be at or below the fluid level threshold.

7. The washing machine appliance of claim 1,
wherein the controller is configured to generate a pump fault signal indicative of drain pump assembly failure when the output signal is generated and when the fluid level at the wash tub is determined to be above the fluid level threshold.

8. The washing machine appliance of claim 7, the controller being configured to:
commence a pump clearing cycle when the pump fault signal is generated.

9. The washing machine appliance of claim 1,
wherein the controller is configured to generate a sensor validation signal indicative of valid fluid level sensor operation when at least the desired speed of the wash basket is achieved within the period of time and the fluid level at the wash tub is at or below the fluid level threshold.

10. A washing machine appliance, comprising:
a wash tub positioned within a cabinet;
a wash basket rotatably mounted within the wash tub and defining a wash chamber;
a motor assembly operably coupled to the wash basket for selectively rotating the wash basket;
a drain pump assembly fluidly coupled to the wash tub for selectively draining wash fluid from the wash tub;
a fluid level sensor configured to generate a fluid level signal corresponding to a fluid level at the wash tub; and
a controller operably coupled to the motor assembly and the drain pump assembly, the controller being configured to:
rotate the wash basket to at least a desired speed;
determine whether an energy parameter threshold of the motor assembly is exceeded when rotating the wash basket within a period of time; and
generate an output signal corresponding to fluid detection at the wash tub when the energy parameter threshold is exceeded when rotating the wash basket within the period of time; and
generate a sensor fault signal indicative of fluid level sensor failure when the fluid level at the wash tub is determined by the fluid level sensor to be above a fluid level threshold and when at least the desired speed of the wash basket is achieved within the period of time.

11. The washing machine appliance of claim 10, the controller being configured to:
determine whether the wash basket is rotated to at least the desired speed within the period of time; and
generate an output signal corresponding to fluid detection at the wash tub when the wash basket fails to rotate to at least the desired speed within the period of time.

12. The washing machine appliance of claim 11, the washing machine appliance comprising:
a speed sensor configured to generate a speed signal corresponding to a speed of rotation of the wash basket,
wherein determining whether at least the desired speed of the wash basket was achieved within the period of time comprises obtaining the speed signal via the speed sensor.

13. The washing machine appliance of claim 10, the controller being configured to:
commence an abatement cycle when the output signal corresponding to fluid detection at the wash tub is generated.

14. The washing machine appliance of claim 13, wherein the abatement cycle comprises operating the drain pump assembly to drain fluid from the wash tub.

15. The washing machine appliance of claim 10,
wherein the controller is configured to generate a sensor fault signal indicative of fluid level sensor failure when the output signal is generated and when the fluid level at the wash tub is determined to be at or below the fluid level threshold.

16. The washing machine appliance of claim 10, wherein the controller is configured to generate a pump fault signal indicative of drain pump assembly failure when the output signal is generated and when the fluid level at the wash tub is determined to be above the fluid level threshold.

17. The washing machine appliance of claim 16, the controller being configured to:

commence a pump clearing cycle when the pump fault signal is generated.

18. The washing machine appliance of claim 10, wherein the controller is configured to generate a sensor validation signal indicative of valid fluid level sensor operation when at least the desired speed of the wash basket is achieved within the period of time and the fluid level at the wash tub is at or below the fluid level threshold.

* * * * *